US006461033B2

(12) United States Patent
Palmer et al.

(10) Patent No.: US 6,461,033 B2
(45) Date of Patent: Oct. 8, 2002

(54) PORTABLE MIXING APPARATUS

(76) Inventors: Douglas R. Palmer, 411 Birch Ave., Genoa, IL (US) 60135; David T. Watkins, 1185 Bode Rd., Elgin, IL (US) 60120

( * ) Notice: Subject to any disclaimer, the term of this patent is extended or adjusted under 35 U.S.C. 154(b) by 38 days.

(21) Appl. No.: 09/756,507

(22) Filed: Jan. 8, 2001

(65) Prior Publication Data

US 2002/0089892 A1 Jul. 11, 2002

(51) Int. Cl.[7] ..... B28C 7/16; B01F 7/18

(52) U.S. Cl. ..... 366/48; 366/52; 366/67; 366/185; 366/304; 366/309

(58) Field of Search ..... 366/46, 52, 67, 366/185, 302, 309, 47, 48, 65, 66, 303, 304, 311

(56) References Cited

U.S. PATENT DOCUMENTS

| | | | | | |
|---|---|---|---|---|---|
| 78,925 | A | * | 6/1868 | Cassard | 366/303 |
| 377,443 | A | * | 2/1888 | Walden | 366/303 |
| 658,486 | A | * | 9/1900 | Hayes | 366/65 |
| 785,249 | A | * | 3/1905 | Burnham | 366/303 |
| 1,801,685 | A | * | 4/1931 | Olson | 366/46 |
| 1,854,732 | A | * | 4/1932 | Beran | 366/304 |
| 2,082,752 | A | * | 6/1937 | Lewis | 366/304 |
| 2,122,187 | A | * | 6/1938 | Vollrath | 366/303 |
| 2,143,750 | A | * | 1/1939 | Darby et al. | 366/304 |
| 2,517,149 | A | * | 8/1950 | Walsh et al. | 366/304 |
| 3,329,348 | A | * | 7/1967 | Pootmans | 366/303 |
| 3,551,114 | A | * | 12/1970 | Hellewell | 366/304 |
| 4,032,117 | A | * | 6/1977 | Burgess | 366/304 |
| 4,091,457 | A | * | 5/1978 | Slywka | 366/304 |
| 4,191,478 | A | * | 3/1980 | Zupancic et al. | 366/65 |
| 6,116,769 | A | * | 9/2000 | Dewall | 366/65 |

* cited by examiner

*Primary Examiner*—Tony G. Soohoo
(74) *Attorney, Agent, or Firm*—Charles F. Meroni, Jr.; Meroni & Meroni, P.C.

(57) ABSTRACT

A portable mixing device for quickly and efficiently combining dry constituents with water to form a mix having a thin batter consistency and no unmixed material. Mounted on a wheeled, pivoting frame, a single individual can use the device to mix the material and pour it in the proper location. The device includes a cylindrical mixing drum and agitation tool mounted within the mixing drum. The agitation tool includes a motor and housing, a drive shaft, wiping assembly, and mixing assembly. The stationary wiping assembly, which extends downward into the mixing drum co-mingles so as to pass closely between and among the blades of the rotating mixing assembly such that the flexible edge portions of the wiping assembly blades are in intermittent contact with the blades of the mixing assembly. The "wiping" action of the wiper assembly on the mixing assembly insures complete and efficient agitation and mix of materials.

26 Claims, 5 Drawing Sheets

PORTABLE MIXING APPARATUS

BACKGROUND OF THE INVENTION

This invention is directed to an inventive mixing device. Specifically, this invention is directed to a mixing device for combining dry constituents with water to form a cement. More specifically, this invention is directed to a portable device for mixing gypsum cement with water to form a thin slurry where the device is operable and transportable by a single individual.

A variety of cementious materials are used in the construction industry. A segment of these materials consist of cements formed from very thin slurries. These materials are so thin in comparison to the relatively thick and stiff common cements, grouts, and mortars, that they require specialized equipment and handling techniques to implement. These thin materials are generally transported to a job site in a large truck, and transferred to the work area by pumping through hoses. Because of the need for large and extensive specialized equipment, and the great number of workers required to operate the equipment, the economic cost of implementing the thin cementious material has prevented it from being used in small-scale construction applications.

An example of the thin cementious material is a specialized gypsum cement commercially known as "Gypcrete". These materials are currently used as self-leveling underlayment cements for leveling floors, as a thermal mass for radiant heat flooring, for acoustic insulation and as a flooring fire retardant. If these products were more portable, excellent results could be found transferring commercial-scale applications to small-scale jobs. Additionally, a portable mixing device would allow use of gypsum cements in jobs having limited access. For instance a portable mixing device could be used in upper stories of a high rise building. In urban areas, where parking and traffic make use of big equipment difficult and expensive, a portable mixing device would provide an economical and logistical solution.

SUMMARY OF THE INVENTION

The inventive portable mixing device allows quick and efficient combination of dry constituents with water to form a mix having a thin batter consistency, no lumps, and no unmixed material. Mounted on a wheeled, pivoting frame, a single individual can use the portable mixing device to mix the material and pour it in the proper location. In this way, the possible applications of this material are greatly expanded, since the material can now be used in a greater variety of applications and for smaller scale projects.

The inventive portable mixing device includes a cylindrical mixing drum which houses an agitation tool and which is mounted to a pivoting, wheeled frame. The agitation tool includes a motor and housing, a drive shaft, wiping assembly, and mixing assembly. The stationary wiping assembly, which extends downward into the mixing drum comingles so as to pass closely between and among the blades of the rotating mixing assembly such that the flexible edge portions of the wiping assembly blades are in intermittent contact with the blades of the mixing assembly. The "wiping" action of the wiper assembly on the mixing assembly insures complete and efficient agitation and mix of materials.

The motor resides within a motor housing, and the motor housing is fixed to the frame so as to reside above the open top end of the mixing drum and so that the drive shaft extends from the motor downward into the mixing drum.

The wiping assembly is made up of a set of elongate blades which are provided with flexible edge portions. The wiping assembly is stationary, being fixed to the motor mount and extending downward into the mid portion of the mixing drum so as to lie generally parallel with the drive shaft.

The mixing assembly is made up of a second set of elongate blades which are fixed to and rotationally driven by the drive shaft. The blades of the mixing assembly extend generally vertically upward from the lower end of the mixing drum so as to pass closely between and among the blades of the wiping assembly. During operation, the flexible edge portions of the wiping assembly blades are in intermittent contact with the rotating blades of the mixing assembly. The flexible edge portions sweep across the surface of mixing blade to remove any accumulation of unmixed material therefrom thus greatly increasing the efficiency of agitation within the mixing drum.

Because the mixing drum is vertically oriented during agitation, elements have been included which are designed to prevent dry components from settling to the bottom of the mixing drum and remaining unmixed. The first such element includes "L" shaped mixing assembly blades which are positioned adjacent to the mixing drum wall near the bottom of the mixing drum. These blades are mounted at an acute angle relative to the vertical so as to drive the mix upward to the mid portion of the drum during agitation. Additionally, the bottom edge of the "L" is radially aligned and extends radially from the drum wall toward the centerline of the mixing drum so as to co-mingle and interact with the second element.

The second element which is designed to prevent dry components from settling to the bottom of the mixing drum and remaining unmixed are a pair of horizontally extending bars which are fixed to and are spaced to lie above the bottom surface of the mixing drum. These bars agitate material which is dislocated from resting on the bottom surface by the sweeping action of the bottom edge of the "L" shaped mixing assembly blades.

The wheeled support frame of the inventive portable mixing device allows the mixing drum to selectively pivot between two positions. The first upright position is used during agitation of materials within the mixing drum. In this position, the longitudinal axis of the mixing drum is vertical and the top end of the mixing drum overlies its bottom end. The second tipped position is used to pour out the contents of the mixing drum. In the second position, the longitudinal axis of the mixing drum is no longer vertical and the top end of the mixing drum is positioned below the bottom end of the mixing drum.

DETAILED DESCRIPTION

Figure 1:
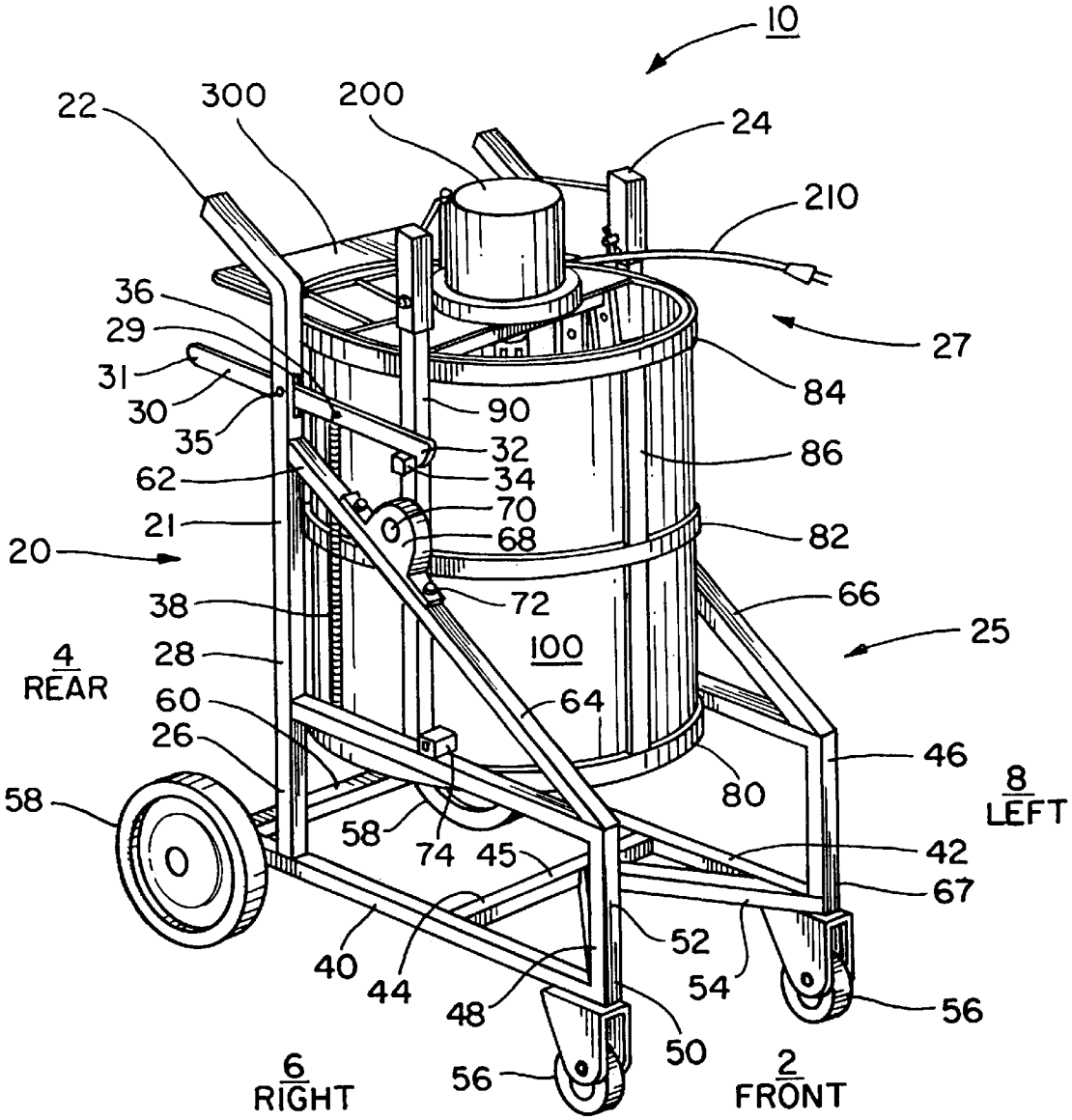
FIG. 1 is a perspective view of the portable mixing apparatus illustrating the mixing drum, the wheel-mounted support frame, and the top mounted agitation tool.

The portable mixing device will now be described with reference to FIGS. 1–7. As illustrated in FIG. 1, portable mixing device 10 consists of an inventive agitation tool which is supported by a wheeled support frame 20. Agitation tool 15 includes cylindrical mixing drum 100, motor 200, drive shaft 150, wiping assembly 400, and mixing assembly 500.

For the purpose of providing a clear description, portable mixing apparatus 10 will be described as having a front end 2 which corresponds to the leading end of the device as it is being pushed from behind, a rear end 4 which corresponds to the trailing end of the device as it is being pushed from behind, and right 6 and left 8 sides as seen from a rear view of the device.

Frame 20 is a series of bars joined to form an open, transparent structure having a non-rotating external frame 25 and an internal frame 27 which is pivotable relative to external frame 25. External frame 25 is provided with a generally rectangular, horizontally oriented, wheeled base to which are mounted several vertically oriented bars which form the superstructure which supports internal frame 27.

Internal frame 27 is generally cylindrical in shape, being formed of a series of rings or hoops 80, 82, 84 which are axially aligned and spaced and which are mutually parallel. Rings 80, 82, 84 are maintained in this axially aligned and spaced configuration by fixing rings 80, 82, 84 to a series of vertically oriented support bars 86, 88, 90, 92. The resulting structure is cylindrically shaped and sized to receive the cylindrical mixing drum 100 within its hollow interior. Ring 80 is positioned at the lower end of internal frame 27, ring 84 is positioned at the upper end of internal frame 27, and ring 82 lies mid way between ring 80 and ring 84 to support the midsection of mixing drum 100. When mixing drum 100 is placed within internal frame 27, the open upper end 110 of mixing drum 100 is aligned with and surrounded by ring 84, the closed lower end 112 of mixing drum 100 is aligned with and surrounded by ring 80, and the longitudinal axis of mixing drum 100 is coincident with the longitudinal axis of internal frame 27.

Vertically oriented support bars 86, 88, 90, 92 are positioned about the circumference of internal frame 27. Support bar 86, located at the front 2 of internal frame 27, and support bar 88, located at the rear 4 of internal frame 27, are thin, elongate rectangular plates which are fixed to upper ring 84 at one end, lower ring 80 at the opposite end, and to mid ring 82 at their midpoints. Support bar 90, located at the right side 6 of internal frame 27, and support bar 92, located at the left side 8 of internal frame 27, are elongate rods having square cross sections. Support bars 90, 92 have a length which is greater than the distance between upper ring 84 and lower ring 80 so that when support bars 90, 92 are fixed at one end to lower ring 80, the respective opposite ends of support bars 90, 92 extend upward above upper ring 84. Support bars 90, 92 are fixed to mid ring 82 and upper ring 84 at their respective intersections with these rings. The upper end 91 of support bar 90, and the upper end 93 of support bar 92, which extend upward above upper ring 84, form mounting posts which receive sleeves 228, 230 of motor mount 220.

Figure 6:
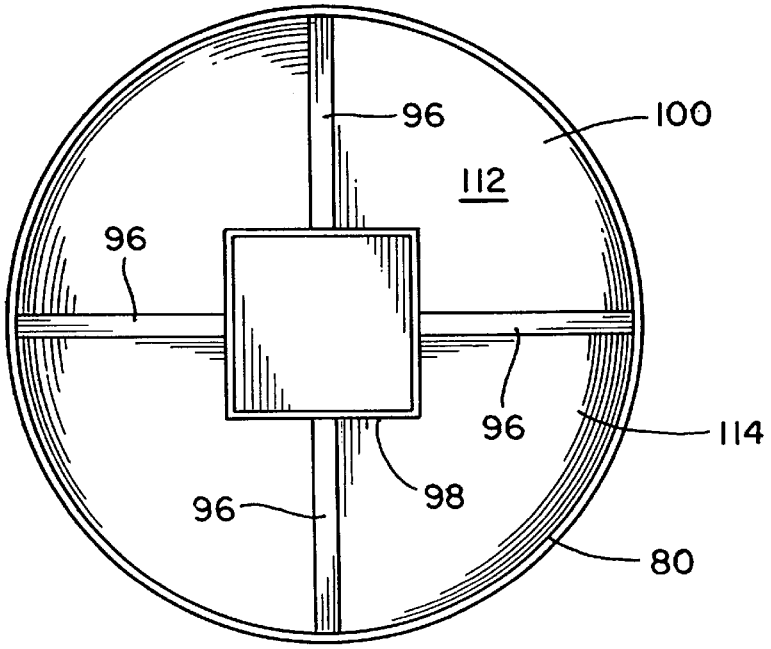
FIG. 6 is a bottom view of the portion of the support frame which supports the lower end of the mixing drum showing the square opening which receives the drive shaft bearing.

Referring now to FIG. 6, lower ring 80 is provided with four lower ring support bars 96 which extend radially inward from the lower edge of ring 80 to form a horizontal platform which supports closed lower end 112 of mixing drum 110. Square loop 98 is a bracket which receives the square bearing housing 120 of drive shaft bearing 122, and is fixed and supported in the horizontal plane by ring support bars 96.

The generally rectangular, horizontally oriented base of external frame 25 is constructed using elongate bars of square cross section. A pair of horizontally aligned, laterally spaced, parallel bars 40, 42 extend from the front 2 to rear 4 of portable mixing device 10. As shown in FIG. 1, a pair of pivoting castor-type wheels 56 support the front 2 of the base. A pair of hubbed wheels 58 support the rear 4 of the base. In the preferred embodiment, wheels 58 are provided in a diameter which is about that of a stair riser. This wheel diameter allows easier handling on stairs.

Figure 4:
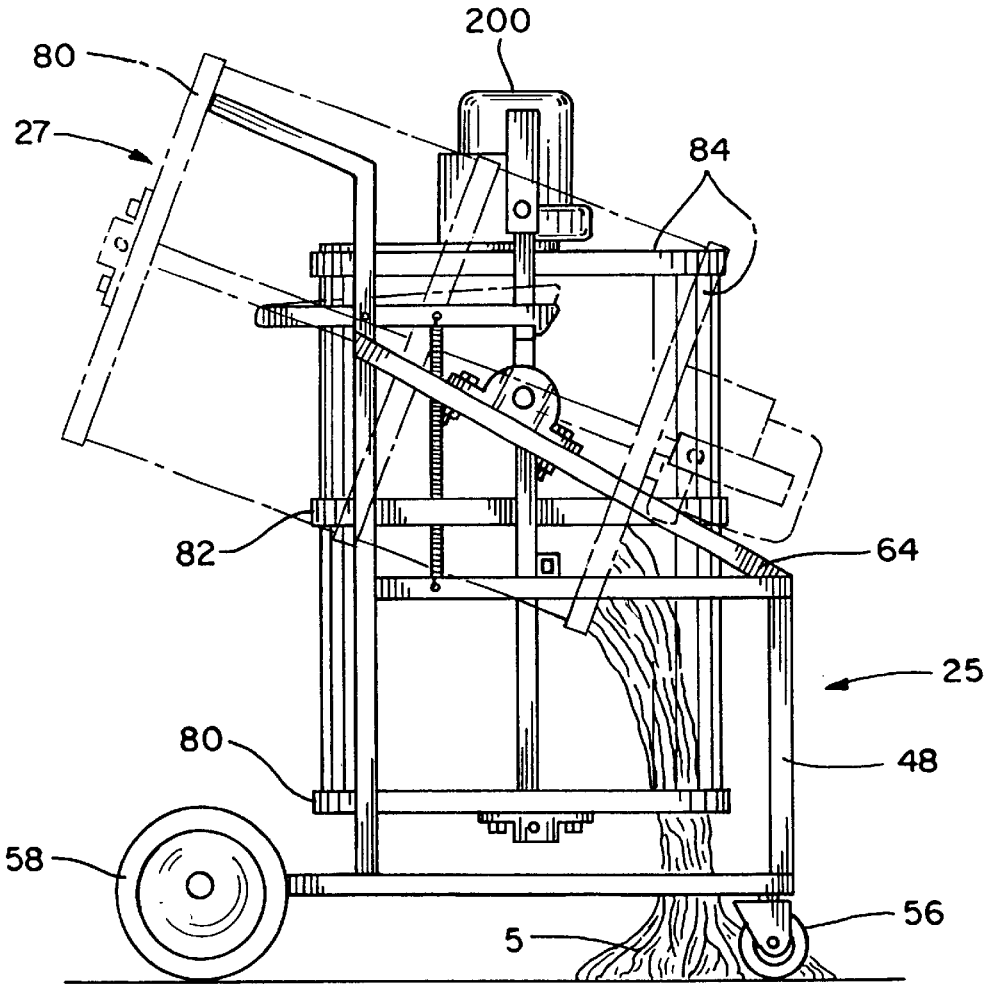
FIG. 4 is a side view of the portable mixing apparatus in an upright position with the tipped, pouring position overlying this view and shown in phantom.

Lateral bars 40, 42 are joined at the rear end by perpendicular cross bar 60. Perpendicular cross bar 44 joins lateral bars 40, 42 in their respective mid sections, and is parallel to perpendicular cross bar 60. A pair of angled cross bars 54 extend from the respective front ends of lateral bars 40, 42 to the midpoint 45 of perpendicular cross bar 44 so as to form a "V" shaped vacancy at the front of the base of external frame 25. This "V" shaped opening allows the mixed material to flow to the ground without interference with external frame 25 when internal frame 27 is pivoted to a pouring position (FIG. 4).

Several vertically oriented bars form the superstructure which supports internal frame 27. A first vertically upright bar extends upwards adjacent to the rear end of each respective lateral bar 40, 42, resulting in a right side rear bar 21 and a left side rear bar 23. Each respective rear bar 21, 23 has an upper end 22, 24, a lower end 26 (only right side shown), and a mid portion 28 (only right side shown) which extends between the upper 22, 24 and lower 26 ends. Upper ends 22, 24 of each respective rear bar 21, 23 are angled toward the rear 4 to form handles for pushing and steering portable mixing device 10.

A second vertically upright bar extends upwards from the front end of each respective lateral bar 40, 42, resulting in a right side front bar 48 and a left side front bar 46. Each respective front bar 48, 46 has an upper end 62 (only right side shown), a lower end 50, 67, and a mid portion 64, 66 which extends between the upper 62 and lower 50, 67 ends. Mid portion 64 of right side front bar 48 is angled so that the upper end 62 intercepts with and is fixed just below upper end 22 of right side rear bar 21. Likewise, mid portion 66 of left side front bar 46 is angled so that the upper end (not shown) intercepts and is fixed just below upper end 24 of left side rear bar 23.

Pivot bearing 68 is mounted to an upper surface of each respective mid portion 64, 66. Bearing 68 receives and pivotally supports bearing shaft 70. A bearing shaft 70 extends radially outward from both the left and right side of mid ring 82. Pivot bearings 68 and shafts 70 allow the internal frame 27, and the mixing drum 100 contained therein, to rotate about a longitudinal axis of the shafts 70 between a first position and a second position.

The first position is an upright orientation such that the longitudinal axis of the internal frame 27 is vertically aligned and upper ring 84 lies above and aligned with lower ring 80. This is the position in which mix contents are added to mixing drum 100 to and in which agitation of the contents occurs. The second position is a tipped orientation such that the longitudinal axis of the internal frame 27 lies at an acute angle to, and below, the horizontal, and upper ring 84 lies below lower ring 80. This is the position in which the contents of mixing drum 100 are emptied by pouring into the desired area.

Stop 74 is mounted to mid portion 64 of right side front bar 48 to prevent internal frame 27 from rotating beyond the second position. Stop 74 is an elongate post having a square cross section which extends inward from external frame 25 toward internal frame 27. As internal frame 27 rotates about bearing shaft 70 relative to external frame 25 to the second position, internal frame 27 interferes with stop 74 and is prevented from over-rotation. Although illustrated in FIG. 7 as mounted to both right side front bar 48 and left side front bar 46, it may alternatively be mounted to one side only.

Frame 20 is provided with latch 30 which allows selective and releasable securement of internal frame 27 to external frame 35 in the first (upright) position. Latch 30 is an elongate thin plate having a first end 31, a second end 32, and a mid portion 33 which extends between the first end 31 and the second end 32. Mid portion 33 is received within slot 29 formed in mid portion 28 of right side rear bar 21 such that first end 31 extends outwardly toward the rear 4 of mixing device 10 to form a handle for operating latch 30. Latch pivot pin 35 is supported within mid portion 28 of right side rear bar 21 such that it passes through latch 30 and slot 29, allowing latch 30 to pivot within slot 29 about a longitudinal axis of latch pivot pin 35. Latch second end 32 is shaped to form a downwardly extending hook.

Right side vertical support bar 90 of internal frame 27 is provided with laterally outward extending latch hook post 34. In operation, latch second end 32 rests on latch hook post 34, the downward extension of latch second end 32 residing on a front 2 surface of latch hook post 34 in order to prevent unwanted forward rotation of internal frame 27 relative to external frame 25. Latch 30 may be disengaged from latch hook post 34 by applying downward pressure on latch first end 31. Such downward pressure results in an upward pivot of latch second end 32 about latch pivot pin 35, allowing second end 32 to be released from latch hook post 34. Latch spring 38 extends from latch mid portion 33 to a lower portion of external frame 25, and maintains latch 30 in engagement with latch hook post 34 unless downward pressure is applied to latch first end 31.

Agitation tool 15, which includes cylindrical mixing drum 100, motor 200, drive shaft 150, wiping assembly 400, and mixing assembly 500, will now be described with respect to FIG. 2.

Mixing drum 100 is an elongate hollow cylinder, and is provided with a longitudinal axis 118, an open upper end 110, and a closed lower end 112. Interior surface 116 of mixing drum 100 defines an interior space, and is opposed to mixing drum exterior surface 114. Mixing drum is sized and shaped to reside within the interior of internal frame 27 such that longitudinal axis 118 coincides with the longitudinal axis of internal frame 27, and such that the open upper end 110 is encircled by upper ring 84.

In the preferred embodiment, mixing drum 100 is sized to produce 2.5 cubic feet of mixed material. This volume of material is large enough to be time- and effort-efficient at a work site, and is also small enough to be handled by a single individual. It is, however, within the scope of the invention to provide mixing drum 100 of larger and/or smaller size, with appropriate scaling of the frame 20, in order to meet the requirements of individual users.

Motor 200 is mounted above mixing drum 100 such that its drive shaft 150 extends downward into mixing drum 100 along its longitudinal axis 118. Motor 200 rests on and is fixed to motor mount 220. Motor mount 220 consists of a thin elongate horizontal plate 224 which is trapezoidal in shape, the longer side edge 236 of the two parallel side edges extending from right to left across the diameter of internal frame 27. Plate 224 is reinforced on its underside adjacent side edge 236 by an elongate angled-section rod 226 having a "L" shaped cross section. Rod 226 is fixed to the underside of plate 224 such that one leg 225 of rod 227 is horizontally oriented and abuts the underside of plate 224. The remaining leg 227 of rod 226 is vertically disposed and lies normal to the underside of plate 224 to form a downwardly extending lip. Both side edge 236 and rod 226 are provided with semi-circular cut-away portion 234 at the center to allow drive shaft 150 to extend therethrough.

The upper surface of horizontal plate 224 is provided with vertical shield 222 which extends upward perpendicular to plate 224 along shorter of the two parallel side edges and along the two adjacent remaining (non-parallel) side edges of the trapezoid. Vertical shield 222 forms a generally hemispherical screen between motor 200 and the rear 4 of portable mixing device 10. Vertical shield 222 protects motor 200 from loose debris during filling of mixing drum 220, which is done at the rear 4 upper end 110 of mixing drum 100 using rest plate 300.

Horizontal plate 224 of motor mount 220 is provided with a pair of elongate hollow sleeves 228, 230 which are square in section and have a closed upper end and open lower end. Sleeve 228 is positioned at the right side of plate 224 such that its outer wall is fixed to and abuts side edge 236 and the right end edge of vertical shield 222. The open lower end of sleeve 228 is aligned with the lower surface of plate 224. Sleeve 228 is sized to receive the upper end 91 of support bar 90 of internal frame 27 within its hollow interior. Sleeve 230 is positioned at the left side of plate 224 such that its outer wall is fixed to and abuts side edge 236 and the left end edge of vertical shield 222. The open lower end of sleeve 230 is aligned with the lower surface of plate 224. Sleeve 230 is sized to receive the upper end 93 of support bar 92 of internal frame 27 within its hollow interior.

A horizontal channel 238 is formed in each sleeve 228, 230 adjacent to its lower end. When sleeves 228, 230 are mounted on support bars 90, 92, channel 238 is in alignment with a horizontal channel (not shown) formed in each respective upper end 91, 93 of support bars 90, 92 to form a continuous through channel which extends completely through each sleeve 228, 230 and its respective support bar 90, 92. Each respective through channel is sized to fittingly receive lock pin 232 therein. When lock pins 232 are in place within the respective through channels, motor mount 220 cannot be removed from the upper ends 91, 93 of support bars 90, 92.

Rest plate 300 is mounted to the upper edge of upper ring 84 and forms a horizontal surface on which bags containing dry mix materials can be rested while bag contents are let into mixing drum 100. Rest plate 300 is generally rectangular in shape and has an upper surface 312 upon which bags are rested, and a lower surface 314 which is opposed to upper surface 312 and abuts upper ring 84. Rest plate 300 overlies the rear half of open upper end 110 of mixing drum 100, and extends horizontally rearward beyond the outer edge of upper ring 84. The portion of rest plate 300 which overlies open upper end 110 is cut away to provide a large semicircular opening 318 through which the contents of the mix bags are passed. A ladder-shaped rack 320 extends horizontally across opening 318 to prevent mix bags from falling into mixing drum 100 or catching on moving parts.

Rest plate 300 is reinforced on its lower surface 314 by an elongate flexible metal strip 310. Rod 310 is bent into a curve along its length to form a semi-circle, and is welded to lower surface 300. Rod 310 is vertically disposed and lies normal to lower surface 300 to form a rim. The semi-circular curve of rod 310 is sized such that the rim slides down into and is tightly received in the open space between the top edge of the open upper end 110 of mixing drum 100 and the top edge of upper ring 84. In operation, mixing drum 100 is placed within internal frame 27, rest plate 300 is placed over the open upper end 110 as described above, and then motor mount 220 is mounted to the upper ends 91, 93 of support bars 90, 92 of internal frame 27, and is secured in place using pins 232.

Drive shaft 150 extends downward from motor 200 through drive shaft opening 115 in closed lower end 112 of mixing drum 100 and terminates in drive shaft bearing 122. Drive shaft bearing 122 is mounted within square shaped bearing housing 120, which is, in turn, fixed to the exterior surface 114 of the closed lower end 112 of mixing drum 100. Wet and dry contents of mixing drum 100 are prevented from contaminating drive shaft bearing 122 by passing drive shaft 150 through a cylindrical bushing 132 which is lined with packing 134. Preferably, packing 134 is comprised of cylindrical layers of square ropes stacked and alternated with rubber gaskets. It is within the scope of this invention, however, to use an alternative packing means. Cylindrical bushing 132 is fixed in longitudinal alignment with the drive shaft to the lower agitating assembly mount plate 130 which is in turn fixed to the interior surface 116 of the closed lower end 112 of mixing drum 100.

Drive shaft 150 is provided with a selectively detachable lovejoy coupling adjacent to motor 200. This coupling allows the motor and motor mount to be easily detached from and reattached to the mixing assembly found at the lower end of drive shaft 150. Ease of detachment is beneficial since separation of portable mixing device 10 into smaller segments allows the device to be more easily transported in and out of buildings, and up and down stairs, by a single individual. It also allows the device to be easily cleaned.

Figure 2:
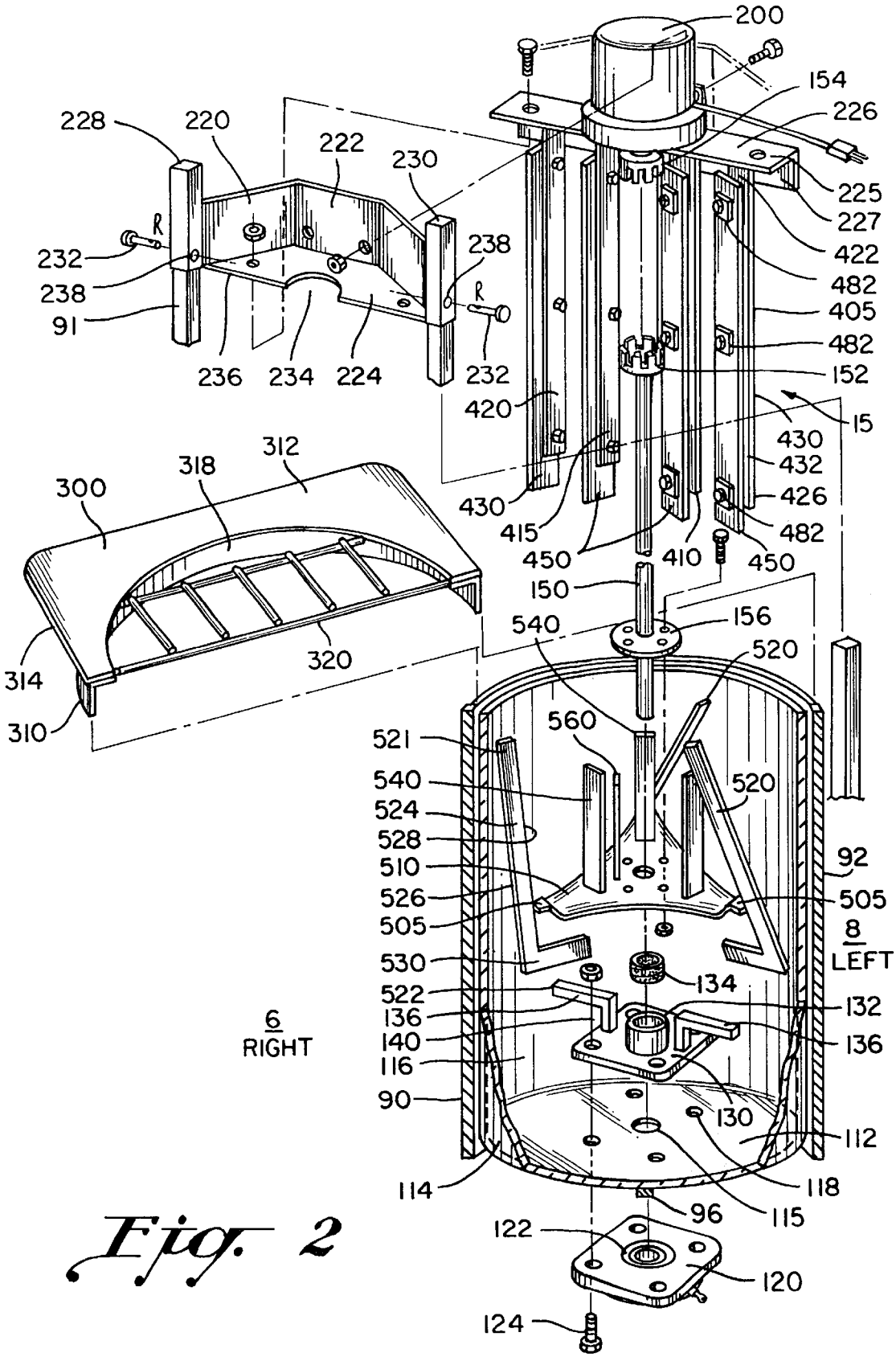
FIG. 2 is an exploded view of the agitation means shown in relation to the rest plate and a side sectional illustration of the mixing drum.
Figure 3:
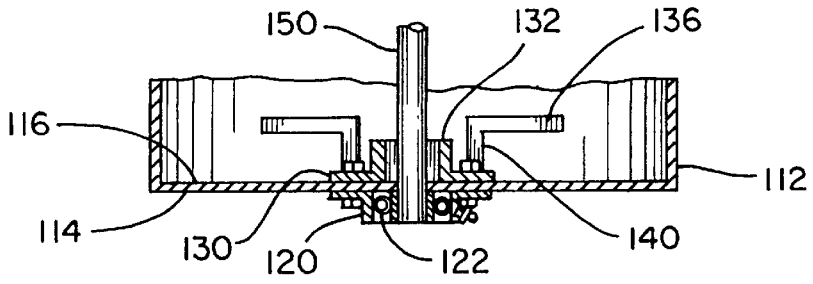
FIG. 3 is a side sectional view of the bearing mount and lower agitating bars at the lower end of the mixing drum.

Wiping assembly 400 is rigidly suspended from the underside of motor mount 220 by welding it to rod 226, which is in turn bolted to the underside of plate 224 (FIG. 2). Wiping assembly 400 is formed of four thin, narrow, elongate rigid strips or tines 405, 410, 415, 420. Each tine is identical and for purpose of illustration, outer right side tine 405 will be described in detail. Tine 405 is an elongate rectangle and is thus provided with a length, a width and a thickness. The length of tine 405 is such that it extends substantially throughout the length of mixing drum 100. Preferably, the length of tine 405 is such that tine 405 extends approximately three-fourths of the length of mixing drum 100. Tine 405 is further provided with a longitudinal axis which lies parallel to the length, and a longitudinal plane which corresponds to the plane which contains both the length and the width. The longitudinal axis of tine 405 lies in parallel to the longitudinal axis of internal frame 27.

Tine 405 has a first, or upper, end 422 which corresponds to the peripheral edge along the width. First end 422 is fixed to motor mount 220. Tine 405 has a second, or lower, end 426 which corresponds to the peripheral edge along the width and which is opposed to and separated from the first end by the length. Tine 405 has a first edge 428 which corresponds to the peripheral edge along the length and lies perpendicular to the plate 224 of motor mount 220, and a second edge 430 which corresponds to the peripheral edge along the length and which is opposed to and separated from first edge 428 by the width.

Tine 405 is further provided with wiper 450. Wiper 450 is an elongate rectangular sheet of resilient and flexible material, preferably rubber, and of approximately the same shape and dimensions as tine 405. Wiper 450 lies abutting tine 405 such that wiper 450 only partially overlies tine 450, resulting in the peripheral edge of wiper 450 extending beyond first edge 428 and from second end 426 of tine 405.

Wiper 450 is fixed to tine 405 using reinforcing plate 480. Reinforcing plate 480 overlies wiper 450 such that wiper 450 is sandwiched between reinforcing plate 480 and tine 405. This layered relationship is maintained by a plurality of through bolts 482, which extend through each of said reinforcing plate 480, wiper 450, and tine 405. Through bolts 482 are used at intervals along the length of tine 405, and in the preferred embodiment, three through bolts 482 are employed.

Figure 5:
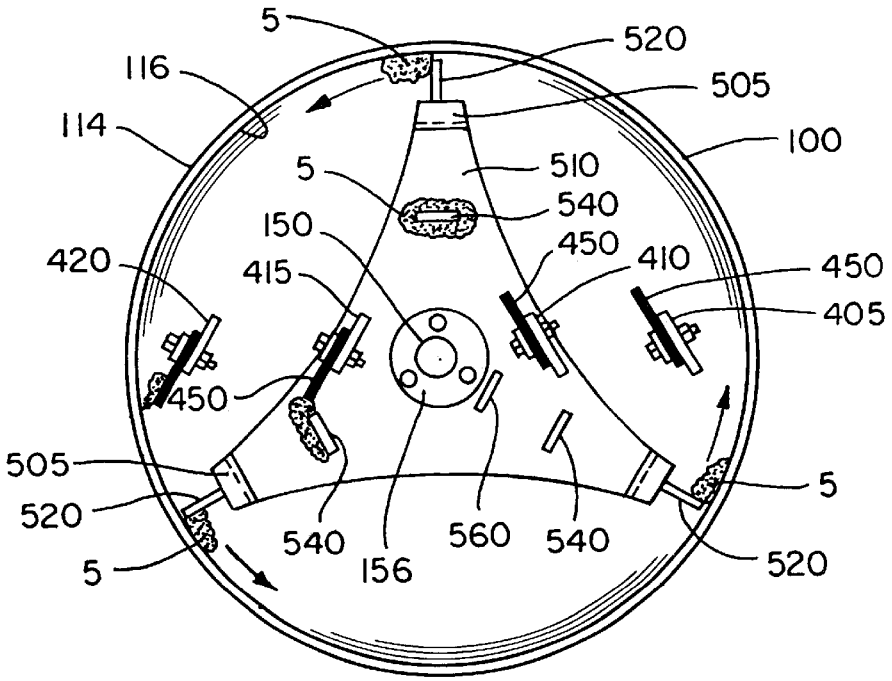
FIG. 5 is a horizontal sectional view of the wiper assembly illustrating the cooperative relationship between the wiper assembly and the mixing assembly.

Each of the four tines 405, 410, 415, and 420 extend rigidly downward from the underside of rod 226 adjacent to side edge 236 so as to intercept line formed by the diameter of internal frame 27 (and mixing drum 100) (FIG. 5). Two tines 405, 410 which correspond to the left outer tine 405 and the left inner tine 410 extend downward such that their respective longitudinal planes are parallel. The longitudinal planes of these tines 405, 410 lie at an angle of approximately +45 degrees relative to the lateral plane, where the lateral plane is defined as a vertical plane which extends laterally from right to left across the diameter of internal frame 27. The remaining tines 415, 420, which correspond to the right outer tine 420 and the right inner tine 415, extend downward such that their longitudinal planes lie at an angle of approximately −45 degrees relative to the lateral plane, or at approximate 90 degrees to the respective longitudinal planes of left side tines 405 and 410.

Mixing assembly 500 is fixed to drive shaft 150 at the lower end of mixing drum 100. Mixing assembly 500 consists of a fin mount plate 510, an inner fin 560, a set of intermediate fins 540, and a set of outer fins 520. Fin mount plate 510 lies perpendicular to and extends radially outward from drive shaft 150 forming a horizontal surface from which the mixing fins 560, 540, and 520 extend. Fin mount plate 510 is generally in the shape of an equilateral triangle where the triangle sides are slightly cut away to provide an inward bow to the sides, and where the triangle apexes have been truncated. This shaping of fin mount plate 510 allows improved material flow within mixing drum 100 during agitation.

Inner fin 560 is a rigid, elongate plate which extends upward from the upper side of fin mount plate 510. Inner fin 560 is an elongate rectangle and is thus provided with a length, a width and a thickness. Inner fin 560 is further provided with a longitudinal axis which lies parallel to its length, and a longitudinal plane which corresponds to the plane which contains both its length and width. The longitudinal axis of inner fin 560 is parallel to the longitudinal axis of mixing drum 100. The longitudinal plane of inner fin 560 lies perpendicular to a radius of cylindrical mixing drum 100. Inner fin 560 is mounted to the upper side of fin mount plate 510 closely adjacent to said drive shaft 150 such that it lies a first radial distance from drive shaft 150. Preferably, this distance is approximately 0.75 inches.

Intermediate fin set 540' is made up of three rigid, elongate plates which extend upward from the upper side of fin mount plate 510. Each intermediate fin 540 of intermediate fin set 540' is equidistant from the remaining intermediate fins 540 and from the longitudinal axis of mixing drum 100. Each intermediate fin 540 is spaced from drive shaft 150 a second radial distance which is greater than the first radial distance. Preferably, this distance is approximately 3.75 inches, and positions each respective intermediate fin 540 midway between drive shaft 150 and a respective truncated apex. Most preferably, each intermediate fin 540 is positioned midway between drive shaft 150 and the interior surface 116 of mixing drum 100 along a radial line that extend from drive shaft 150 to a truncated apex.

Each intermediate fin 540 is an elongate rectangle and is thus provided with a length, a width and a thickness. Each intermediate fin 540 is further provided with a longitudinal axis which lies parallel to its length, and a longitudinal plane which corresponds to the plane which contains both its length and width. The longitudinal axis of each intermediate fin 540 is parallel to the longitudinal axis of mixing drum 100. The longitudinal plane of each intermediate fin 540 lies perpendicular to a radius of cylindrical mixing drum 100.

Outer fin set 520' is made up of three rigid, elongate plates which extend both upward and downward from the peripheral edge of fin mount plate 510. Each outer fin 520 of outer fin set 520' is provided with a length, a width and a thickness, the thickness being very small relative to the length and width, and the width being small relative to the length. Each outer fin 520 is provided with a longitudinal axis which lies parallel to its length, and a longitudinal plane which corresponds to the plane which contains both its length and width.

Each outer fin 520 has a first end 521 which corresponds to the peripheral edge along the width at the upper end of outer fin 520, and a second end 522 which corresponds to the peripheral edge along the width at the lower end of outer fin 520 and which is opposed to and separated from first end 521 by its length.

Each outer fin 520 has a first edge 526 which corresponds to the peripheral edge along the length and lies adjacent to and confronting interior surface 116 of mixing drum 100. Second edge 528 of each outer fin 520 corresponds to the peripheral edge along the length and is opposed to and separated from first edge 526 by the width of outer fin. Each outer fin 520 is oriented such that second edge 528 lies so as to face drive shaft 150.

The respective second ends 522 of each outer fin 520 is provided with a widened portion 530 which extends radially inward toward drive shaft 150 from second edge 528 such that the appearance of the width of each outer fin 520 is that of the letter "L".

Each outer fin 520 has a mid portion 524 which extends between first end 521 and second end 522. An outer fin 520 is mounted to the periphery of fin mount plate 510 at each truncated apex. Each outer fin 520 is suspended from its respective second edge 528 at a location in mid portion 524 so that first end 521 lies above fin mount plate 510 and second end 522 lies below fin mount plate 510.

The longitudinal axis of each outer fin 520 is not parallel to the longitudinal axis of mixing drum 100, rather, the longitudinal axis of each outer fin lies at angle relative to the vertical such that when viewed facing first edge 526, first (upper) end 521 lies to the left of second (lower) end 522. In operation, as drive shaft 150 rotates each outer fin 520 travels about the circumference of the drum such that the widened second (lower) end 522 leads and the first (upper) end 521 trails. The resulting effect of this angled fin is that the mix which has settled in the lower regions of mixing drum 100 is dislodged and urged upward, greatly improving the quality of the agitation with mixing drum 100.

Each outer fin 520 is equidistant from the remaining outer fins 520 and from the longitudinal axis of mixing drum 100. Each outer fin 520 is spaced from drive shaft 150 a third radial distance which is greater than the first and second radial distances. Preferably, this distance is approximately 9.5 inches, and positions each respective outer fin 520 such that it extends outwardly from the peripheral edge of a respective truncated apex. Most preferably, outer fin 520 is positioned as follows: Second edge 526 is closely adjacent to and confronts the interior surface 116 of the side wall of mixing drum 100. Second end 522, located below fin mount plate 510, is closely adjacent to and confronts the interior surface 116 of the closed lower end 112 of mixing drum 100. Widened portion 530 is radially aligned to provide a sweeping action across lower end 112. Mid portion 524 is provided in a length which locates first end 521 above fin mount plate 510 adjacent to but spaced apart from the open upper end 110 of mixing drum 100.

Figure 7:
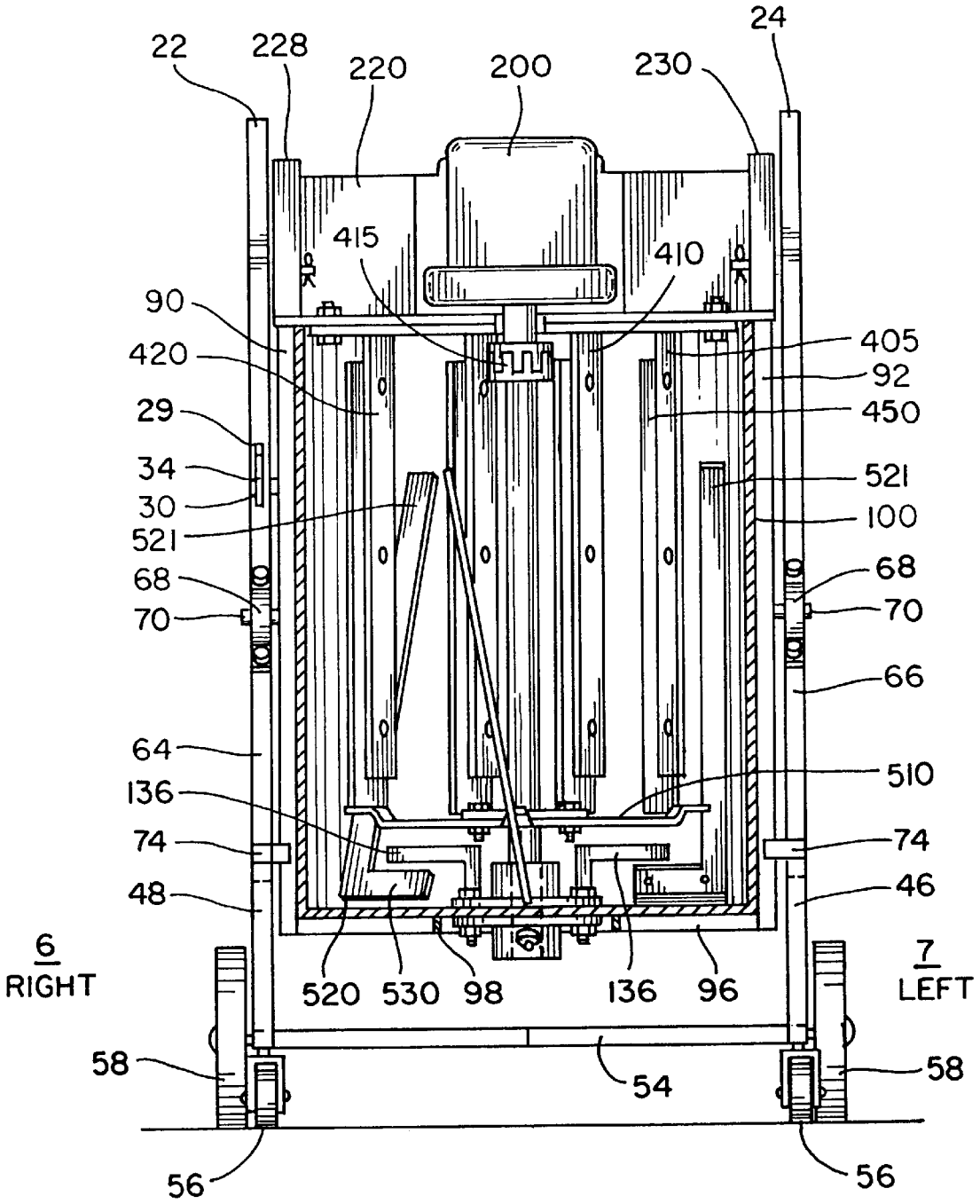
FIG. 7 is a front sectional view of the portable mixing apparatus, showing the interrelationships of the wiper assembly and the mixing assembly and showing that the wiper assembly is suspended from the top of the cylindrical mixing container.

Mixing assembly 500, which consists of inner fin 560, intermediate fin set 540', and outer fin set 520' extend from fin mount plate 510, which is in turn fixed to drive shaft 150. Thus each individual fin travels one complete revolution about the interior of mixing drum 100 for each revolution of drive shaft 150. Each first end 521 of each outer fin 520, each intermediate fin 540, and interior fin 560 extend upward from fin mount plate 510 and are provided with respective lengths so as to cooperatively co-mingle with tines 405, 410, 415, and 420. Additionally, each first end 521 of each outer fin 520 and each intermediate fin 540 intermittently contact the wipers 450 of tines 405, 410, 415, and 420 to provide an extremely efficient agitation source. Referring now to FIGS. 5 and 7, the respective first ends 521 of each outer fin 520 contact wiper 450 of right outer tine 420 in sequence during each rotation. Each intermediate fin 540 is sequentially in momentary contact with wiper 450 of right inner tine 415 and left outer tine 405 during each rotation so that both surfaces of each intermediate fin 540 is cleaned. Inner fin 560 passes between drive shaft 150 and respective left and right inner tines 410, 415, making contact with the wiper 450 of tine 410. Wipers 450 sweep across the surface of each fin 560, 540, 520, to remove any accumulated of unmixed material therefrom and to prevent any buildup of materials on fin surfaces thus greatly increasing the efficiency of agitation within mixing drum 100.

Lower agitating bars 136 are a pair of stationary, elongate rods which are located adjacent the closed lower end 112 of mixing drum 100. Lower agitating bars 136 are horizontally oriented and extend radially outward. Placed on opposing sides of drive shaft 150, lower agitating bars 136 extend between the underside of fin mount plate 510 and above the respective widened portions 530 of outer fin set 520'. This configuration allows lower agitating bars 136 to cooperatively co-mingle with widened portions 530 of outer fin set 520' preventing accumulation of unmixed material below fin mount plate 510 and increasing agitation in this region of the interior of mixing drum 100.

Lower agitation bars 136 are supported by posts 140 which extend vertically upward from lower agitation assembly plate 130. Posts 140 lie adjacent to and on opposing sides of cylindrical bushing 132, which receives both drive shaft 150 and packing material 134.

In operation, motor 200 causes drive shaft 150 to rotate at 60 revolutions per second, thus each fin 520, 540, 560 of the mixing assembly 500 travels a complete revolution once every second. Because the wiping assembly 400 is configure to extend completely across the diameter of mixing drum 100, each fin 520, 540, 560 of the mixing assembly 500 passes through the tines 405, 410, 415, 420 of wiping assembly 400 two times per second. This motor speed is completely adequate for provide very successful mixing.

We claim:

1. A portable mixing apparatus for quick and efficient production of a loose, fluid cement of uniform and thin consistency, the portable mixing apparatus being is sized to be transported and operated by a single individual, the portable mixing apparatus comprising a frame, a drum, and agitation means, wherein said drum is a hollow cylinder in shape and has a longitudinal axis, an open upper end, and a closed lower end, said drum having an interior surface and an exterior surface, said drum receiving the materials to be mixed within the interior space of the hollow cylinder, said frame is comprised of an external portion and an internal portion, said external portion having a generally rectangular shape and being mounted on wheels, said internal portion having a generally cylindrical shape, an upper end, a lower end, and a longitudinal axis, the internal portion being pivotally mounted to an interior aspect of said external portion, said internal portion being sized to receive said drum portion therewithin such that the longitudinal axis of the drum coincides with the longitudinal axis of the internal portion, and such that the upper end of said internal portion coincides with the upper end of said drum, said agitation means is comprised of a motor, a drive shaft, wiping means, and mixing means, said drive shaft has a first end which extends from and is driven by said motor, and wherein said drive shaft has a second end which is opposed to said first end, said wiping means is stationary and extends downward into said interior space of said drum said mixing means is mounted to said second end of said drive shaft and extends upward to co mingle with said wiping means to provide efficient agitation.

2. The portable mixing apparatus of claim 1 wherein said agitation means is mounted to said frame such that the drive shaft coincides with the longitudinal axis of the internal portion of said frame, and wherein the internal portion of said frame is provided with pivoting means so as to be pivotable relative to said external portion between a first position and a second position, the first position oriented such that the longitudinal axis of the internal portion is vertically aligned and the upper end of the internal portion lies above the lower end of the internal portion, the second position oriented such that the longitudinal axis of the internal portion lies at an acute angle to the horizontal and the upper end of the internal portion lies below the lower end of the internal portion.

3. The portable mixing apparatus of claim 2 wherein said drive shaft is provided with a detachable coupling means, said detachable coupling means being located on the drive shaft between the motor and the mixing means so that said mixing means may be selectively detached and reattached to said motor.

4. The portable mixing apparatus of claim 3 wherein the agitation means is provided with a mounting plate, said mounting plate extending across the open upper end of said drum, the motor being mounted to said mounting plate such that the drive shaft extends perpendicularly from said plate so as to be parallel to the longitudinal axis of the drum, wherein the wiping means further comprises a mixing fork, said mixing fork comprising a plurality of tines, said plurality of tines extending from said mounting plate such that they lie parallel to said drive shaft, perpendicular to said mounting plate, and extend into the interior of the drum.

5. The portable mixing apparatus of claim 4 wherein each of said plurality of tines comprises a rigid, elongate rectangular strip, said rectangular strip comprising a length, a width and a thickness, the thickness being very small relative to the length and width, and the width being small relative to the length, said rectangular strip comprising a longitudinal axis which lies parallel to the length, and a longitudinal plane which corresponds to the plane which contains both the length and the width, the rectangular strip having a first end which corresponds to the peripheral edge along the width and is fixed to said mounting plate, the rectangular strip having a second end which corresponds to the peripheral edge along the width and which is opposed to and separated from the first end by the length of the rectangular strip, the rectangular strip having a first edge which corresponds to the peripheral edge along the length and lies perpendicular to the mounting plate, the rectangular strip having a second edge which corresponds to the peripheral edge along the length and which is opposed to and separated from the first edge by the width of the rectangular strip, wherein each of said tines is provided with wiping portion, said wiping portion comprising an elongate rectangular sheet of resilient and flexible material, said wiping portion extending from said first edge and from said second end of each respective tine.

6. The portable mixing apparatus of claim 5 wherein said mounting plate extends across the open upper end of said drum such that the longitudinal axes of each of said plurality of tines extend from said mounting plate so as to intercept a line formed by the diameter of said drum.

7. The portable mixing apparatus of claim 6 wherein said plurality of tines comprises four tines, each of said four tines having a longitudinal axis, each respective longitudinal axis being parallel to the other longitudinal axes, wherein two tines of said four tines are aligned such that their respective longitudinal planes are parallel to a first plane, and wherein the remaining two tines of said four tines are aligned such that their respective longitudinal planes are parallel to a second plane, said first plane and said second plane are aligned at an angle to each other.

8. The portable mixing apparatus of claim 6 wherein the mixing means comprises a fin mount plate which is mounted to said second end of said drive shaft, the fin mount plate lying perpendicular to and extending radially outward from the drive shaft, the mixing means further comprises a plurality of fins, said plurality of fins mounted so as to extend from said fin mount plate and so as to cooperatively co-mingle with and intermittently contact said wiping portions of said plurality of tines to provide an extremely efficient agitation source.

9. The portable mixing apparatus of claim 8 wherein said plurality of fins comprises an inner fin set, an intermediate fin set, and an outer fin set, said inner fin set comprising at least one inner fin which comprises a rigid, elongate rectangular strip, said at least one inner fin having a longitudinal axis which is parallel to said longitudinal axis of said drum, said at least one inner fin being located adjacent to said drive shaft and being positioned on said fin mount plate such that it lies a first radial distance from said longitudinal axis of said drum, said intermediate fin set comprising three intermediate fins, each of said three intermediate fins comprising a rigid, elongate rectangular strip having a longitudinal axis which is parallel to said longitudinal axis of said drum, each of said three intermediate fins being positioned on said fin mount plate such that it is equidistant from said drive shaft and from said remaining intermediate fins, each of said three intermediate fins being positioned on said fin mount plate such that it lies a second radial distance from said longitudinal axis of said drum where said second radial distance is greater than said first radial distance, said outer fin set comprising three outer fins, each of said three outer fins comprising a rigid, elongate strip having a longitudinal axis which is not parallel to said longitudinal axis of said drum, each of said three outer fins being positioned on said fin mount plate such that it is equidistant from said drive shaft and from said remaining intermediate fins, each of said three intermediate fins being positioned on said fin mount plate such that it lies a third radial distance from said longitudinal axis of said drum where said third radial distance is greater than said second radial distance.

10. The portable mixing apparatus of claim 9 wherein each of said three outer fins comprises a length, a width and a thickness, the thickness being very small relative to the length and width, and the width being small relative to the length, each of said three outer fins comprising a longitudinal axis which lies parallel to the length, and a longitudinal plane which corresponds to the plane which contains both the length and the width, each of said three outer fins having a first end which corresponds to the peripheral edge along the width, each of said three outer fins having a second end which corresponds to the peripheral edge along the width and which is opposed to and separated from the first end by the length of the outer fin, each of said three outer fins having a first edge which corresponds to the peripheral edge along the length and lies adjacent to and confronting said interior surface of said drum, each of the three outer fins having a second edge which corresponds to the peripheral edge along the length and which is opposed to and separated from the first edge by the width of outer fin, said second edge lying so as to face said drive shaft, said second end of each of the three outer fins being provided with a widened portion which extends radially inward toward said drive shaft from said second edge such that the appearance of said outer fin in said longitudinal plane that of the letter "L", each of said three outer fins having a mid portion which lies between said first end and said second end, each of said three outer fins being mounted to the periphery of said fin mount plate such that each of said three outer fins is suspended from said second edge at a location in said mid portion so that said first end of each of said three outer fins lies above said fin mount plate and said second end of each of said three outer fins lies below said fin mount plate.

11. The portable mixing apparatus of claim 10 wherein said interior surface of said closed lower end of said drum is provided with a plurality of lower agitating bars, said lower agitating bars comprising elongate rigid rods which are mounted to posts extending upward from interior surface of said closed lower end of said drum such that said lower agitating bars are spaced apart from and lie parallel to said closed lower end of said drum, said lower agitating bars being spaced apart from said closed lower end of said drum a distance which is sufficient to allow said widened portion of said second end of each of said three outer fins to pass between said lower agitating bars and said closed lower end of said drum and so as to allow said lower agitating bars to cooperatively co-mingle with said second end of each of said three outer fins to provide efficient agitation at the lower end of said drum and to prevent settling of contents at the lower end of said drum.

12. The portable mixing apparatus of claim 10 wherein said lower end of said drum is provided with an opening centered on the longitudinal axis of said drum, wherein a bearing is mounted to said outer surface of said lower end of said drum such that said bearing is aligned with said opening, and wherein said second end of said drive shaft extends below said fin mount plate so as to pass through said opening in said lower end of said drum and is received within and supported by said bearing.

13. The portable mixing apparatus of claim 4 wherein said exterior portion of said frame is comprised of a generally rectangular horizontally oriented wheeled base, a first pair of vertically upright bars, a second pair of vertically upright bars, and a third pair of vertically upright bars, wherein said wheeled based is comprised of a front end, a rear end, a left side, and a right side, of said first pair of vertically upright bars is comprised of a first right side bar and a first left side bar, each of said first right side bar and said first left side bar comprising an upper end, a lower end, and a mid portion which extends between said upper end and said lower end, said lower end of said first right side bar being fixed to the right side of said wheeled base adjacent to said rear end, said lower end of said first left side bar being fixed to the left side of said wheeled base adjacent to said rear end, each of said upper ends of said first pair of vertically upright bars being angled in the direction of the rear end so as to provide a handle for pushing and steering said frame, said second pair of vertically upright bars is comprised of a second right side bar and a second left side bar, each of said second right side bar and said second left side bar comprising an upper end, a lower end, and a mid portion which extends between said upper end and said lower end, said lower end of said second right side bar being fixed to the right side of said wheeled base adjacent to said front end, said lower end of said second left side bar being fixed to the left side of said wheeled base adjacent to said front end, the mid portions of each of said upper ends of said second pair of vertically upright bars being angled in the direction of the rear end so that the upper end of said second right side bar intersects and is fixed to the mid portion of the first right side bar and so that upper end of said second left side bar intersects and is fixed to the mid portion of the first left side bar.

14. The portable mixing apparatus of claim 13 wherein each of said upper ends of said respective second right side bar and said second left side bar is provided with a bearing which receives said pivoting means of said internal frame.

15. The portable mixing apparatus of claim 14 wherein said internal frame comprises three circumferential rings which are axially aligned, mutually parallel, and spaced apart from each other along the longitudinal axis of the internal frame, said three circumferential rings comprising a top ring, a mid ring, and a bottom ring, said internal frame comprises a first vertical bar, a second vertical bar, a third vertical bar, and a fourth vertical bar, each respective first, second, third, and fourth vertical bar comprising a top end, a bottom end, and a mid point located mid way between said top end and said bottom end, each respective first and third vertical bar comprising a first length, each respective second and fourth vertical bar comprising a second length wherein said second length is greater than said first length, each of said respective top ends of said respective first and third vertical bars is fixed to said top ring, each of said respective second and fourth vertical bars is fixed to said top ring at a location adjacent to their respective top ends, each of said respective mid points of said respective first and third vertical bars is fixed to said mid ring, each of said respective second and fourth vertical bars is fixed to said mid ring at a location adjacent to and below their respective mid points, each of said respective bottom ends of said respective first, second, third, and fourth vertical bars is fixed to said bottom ring, wherein said first vertical bar is located adjacent said front end of said external frame, said second vertical bar is located adjacent said left side of said external frame, said third vertical bar is located adjacent to said rear side of said external frame, and said fourth vertical bar is located adjacent to said right side of said external frame such that said respective first, second, third, and fourth vertical bars are spaced equidistantly about said three circumferential rings, said three circumferential rings maintained in said axially aligned, mutually parallel, and spaced apart configuration through support of said respective first, second, third, and fourth vertical bars.

16. The portable mixing apparatus of claim 15 wherein said respective top ends of said second vertical bar and said fourth vertical bars extend above said top ring, and wherein said motor mount is provided with a pair of hollow elongate post caps which are sized and positioned to receive said top ends of said second and fourth vertical bars therewithin so as to provide a means for securing said motor mount to said internal frame.

17. The portable mixing apparatus of claim 16 wherein said fourth vertical bar is provided with a selective securement means for releasably fixing said internal portion of said frame relative to said external portion in said first position.

18. The portable mixing apparatus of claim 17 wherein said fourth vertical bar is provided with a stop means for preventing said internal portion of said frame from pivoting beyond said second position.

19. An apparatus for mixing comprising a frame, a mixing drum, and mixing means, wherein said frame is wheel mounted and supports said mixing drum, said mixing drum is a hollow cylinder having a closed lower end, open upper end, and a longitudinal axis which extends along the centerline between said closed lower end and said open upper end, said mixing means comprises a motor, a drive shaft which extends from said motor along said longitudinal axis through said mixing drum, wiping means, and agitation means, wherein said wiping means and said agitation means cooperatively intermingle within the interior space of the mixing drum such that said wiping means and said agitation means intermittently contact each other.

20. The apparatus for mixing of claim 19 wherein said wiping means comprises a first set of blades which are suspended from above said mixing drum and extend vertically down into the interior of the mixing drum, said wiping means being fixed in space relative to said mixing drum, said agitation means comprises a second set of blades which are fixed to said drive shaft so as to be supported within the interior of the drum and so as to be rotatable about the longitudinal axis, said second set of blades extending upward to cooperatively intermingle with first set of blades.

21. The apparatus for mixing of claim 20 wherein said motor is provided with a motor housing, said motor housing extending across said open upper end of said mixing drum, said first said of blades being fixed to and extending vertically downward from an underside of said motor housing.

22. The apparatus for mixing of claim 21 wherein each blade of said first set of blades is comprised of an elongate, rigid, flat, rectangular primary plate, said primary plate comprising a first end, a second end, and a mid portion which extends between said first end and said second end, said primary plate comprising a first face, and a second face which is opposed to said first face, said primary plate comprising a primary peripheral edge which corresponds to the thickness of said primary plate and separates said first face and said second face, said peripheral edge at said first end of said primary plate being fixed to said underside of said motor housing.

23. The apparatus for mixing of claim 22 wherein each blade of said first set of blades is provided with a elongate, flexible, flat, rectangular, secondary plate, said secondary plate comprising a first end, a second end, and a mid portion which extends between said first end and said second end, said secondary plate comprising a first face, and a second face which is opposed to said first face, said secondary plate comprising a secondary peripheral edge which corresponds to the thickness of said secondary plate and separates said first face and said second face, said secondary plate being fixed to said first face of said primary plate such that said second face of said secondary plate abuttingly confronts and partially overlies said first face of said primary plate such that said secondary peripheral edge is longitudinally and laterally offset from said primary peripheral edge, the portions of said secondary plate which extend beyond said primary plate defining a wiper.

24. The apparatus for mixing of claim 23 wherein said second set of blades of said agitation means is intermittently in contact with said wiper of said first set of blades.

25. A portable mixing device comprising a combination mixing apparatus and support frame for quickly and efficient agitation of dry particulate materials and liquid to a thin, wet slurry consistency, said mixing apparatus comprising agitation means and container means for receiving said materials and liquid, wherein said support frame rests on wheels for easy positioning of said device, and said support frame supports said mixing apparatus in space, said agitation means comprising a motor, a motor housing, a drive shaft, wiping means, and mixing means, said container means comprising an elongate hollow cylindrical mixing drum, said drum having an open top end, a closed bottom end, and a longitudinal axis which extends along the centerline between said top end and said bottom end, wherein said motor is fixed to said motor housing, said motor housing is fixed to said external frame so as to reside above said open top end of said drum, said drive shaft extends downward from the motor into said drum so as to be coincident with said longitudinal axis, said wiping means comprising a first plurality of elongate blades, said first plurality of blades having flexible edge portions, said first plurality of blades being fixed to and extending downward into said drum from said motor mount so as to lie in parallel with said drive shaft, said mixing means comprising a second plurality of elongate blades, said second plurality of blades extending within said drum so as to pass closely between said first plurality of elongate blades such that said flexible edge portions of said first plurality of blades is in intermittent contact with said second plurality of elongate blades.

26. The portable mixing device of claim 25 wherein said support frame allows said container means to selectively pivot between a first upright position wherein said longitudinal axis is vertical and said open top end of said drum overlies said closed bottom end of said drum, and a second tipped position wherein said longitudinal axis is not vertical and said top end of said drum is positioned below said bottom end of said drum.

* * * * *